US005328245A

United States Patent [19]

Marks et al.

[11] Patent Number: 5,328,245

[45] Date of Patent: Jul. 12, 1994

[54] CHAIR HAVING ADJUSTABLE BACK SUPPORT

[75] Inventors: Thomas J. Marks, Portland; Daniel F. Rohrer, Powell Butte, both of Oreg.

[73] Assignee: Thomas J. Marks, Portland, Oreg.

[21] Appl. No.: 969,031

[22] Filed: Oct. 30, 1992

[51] Int. Cl.[5] ..... A47C 3/20

[52] U.S. Cl. ..... 297/284.3; 297/284.8; 297/452.29

[58] Field of Search ..... 297/284.3, 284.8, 460, 297/452.29; 5/633, 239, 241-243

[56] References Cited

U.S. PATENT DOCUMENTS

| | | | |
|---|---|---|---|
| 844,245 | 2/1907 | Budd | 5/239 |
| 958,356 | 5/1910 | Bode | 297/284.3 |
| 3,081,129 | 3/1963 | Ridder | 297/284.3 X |
| 3,112,137 | 11/1963 | Dreuth | 297/284.8 X |
| 3,608,961 | 9/1971 | Von Heck | 297/284 |
| 3,717,376 | 2/1973 | Lutchansky | 297/284 |
| 3,877,750 | 4/1975 | Scholpp | 297/284.3 |
| 3,990,742 | 11/1976 | Glass et al. | 297/283 |
| 3,995,335 | 12/1976 | Neely | 5/633 |
| 4,437,702 | 3/1984 | Agosta | 297/284.8 |
| 4,615,856 | 10/1986 | Silverman | 264/222 |
| 4,647,066 | 3/1987 | Walton | 297/284.8 X |
| 4,660,887 | 4/1987 | Fleming et al. | 297/445 |
| 4,828,325 | 5/1989 | Brooks | 297/458 |
| 4,840,425 | 6/1989 | Noble | 297/284 |
| 4,890,235 | 12/1989 | Reger et al. | 364/468 |
| 4,890,885 | 1/1990 | Grossmann | 297/284 |
| 4,944,554 | 7/1990 | Gross et al. | 297/284 |
| 4,993,164 | 2/1991 | Jacobsen | 297/284 X |
| 5,018,786 | 5/1991 | Goldstein et al. | 297/284 |

FOREIGN PATENT DOCUMENTS

| | | | |
|---|---|---|---|
| 0141652 | 5/1985 | European Pat. Off. | 297/284.3 |
| 0236292 | 9/1987 | European Pat. Off. | 5/239 |
| 1404659 | 11/1968 | Fed. Rep. of Germany | 297/284.3 |
| 537080 | 5/1922 | France | 5/239 |
| 0280792 | 9/1970 | U.S.S.R. | 297/284.3 |

*Primary Examiner*—Lloyd A. Gall

*Attorney, Agent, or Firm*—Klarquist, Sparkman, Campbell, Leigh & Whinston

[57] ABSTRACT

A chair is provided with an adjustable back support which quickly and easily conforms to the contours of the user's back. The chair has a seat and an upwardly extending support bar. A number of segments are received on the support bar to define a support surface for supporting the back of the user. The segments are movable to allow the support surface to conform to the back of the seated person. A locking mechanism allows the person to lock the segments in the desired position.

6 Claims, 4 Drawing Sheets

CHAIR HAVING ADJUSTABLE BACK SUPPORT

BACKGROUND OF THE INVENTION

1. Field of the Invention

The present invention relates to chairs, and particularly to chairs having backs that are adjustable to conform to the contour of a user's back.

2. Description of Related Art

In today's society, people spend an increasing amount of time sitting. The employment market is shifting from manufacturing jobs to information processing jobs. As a result, more and more people are employed in jobs which require a great deal of time sitting. Further, many people devote large amounts of leisure time to activities, such as watching television, which are usually done sitting.

Given the dramatic increase in the amount of time people spend sitting, it is important to provide chairs which are both comfortable and safe. One of the most important features of any chair is the manner in which it supports a user's back. If the chair provides inadequate support or supports the back in an improper position, the user may become uncomfortable after sitting for an extended period of time. Prolonged sitting in a chair with improper or inadequate back support may also contribute to fatigue, poor posture, and even chronic back problems. On the other hand, a chair which provides the proper type of support may avoid, or even help to correct, such problems.

People's backs are different in size, shape, and strength. Because each person's back has a unique configuration, each person's back has unique support requirements. As a result, the ideal back support will vary from individual to individual.

Unfortunately, chairs are typically designed with a back support sized and shaped for the average individual. In an effort to produce more comfortable and healthy seating, some chairs, particularly those commonly used in the office environment, are configured to allow adjustment of some features, such as the height and angle of the back support. However, the adjustable features in such chairs are limited. As a result, such chairs cannot provide everyone the proper fit and support.

A variety of chairs have been developed in attempts to improve on the comfort and support offered by standard office furniture. Typically this is done by increasing the number and types of adjustments which the user can make to the chair. For example, the chair described in U.S. Pat. No. 3,990,742 to Glass has a number of individual cam-like members extending laterally across the chair. These members can be individually rotated to modify the shape of the back support. Although this type of system offers increased adjustability, it sacrifices convenience. Given the number of cam members that must be adjusted for each user, it is impractical for a variety of users to use such a chair. U.S. Pat. No. 5,018,786 to Goldstein also describes a chair having a number of individually adjustable back support members. Again, given the large number of individual adjustments necessary to configure the chair to each user, this type of chair is ill-suited for the office environment.

Some chairs offer automatic adjustment systems. For example, U.S. Pat. No. 4,944,554 to Gross employs a number of motors to automatically adjust the configuration of a chair to a predetermined spinal profile. However, the complicated electrical and mechanical interfaces required for this type of chair limit its reliability, availability, and practicality in many environments.

In a few types of chairs, such as wheel chairs, it is not uncommon for the back support to be custom fit to the user. For example, U.S. Pat. No. 4,615,856 to Silverman, U.S. Pat. No. 4,828,325 to Brooks, and U.S. Pat. No. 4,890,235 to Reger all describe high quality customized chairs. However, each of these chairs has the common drawback of providing a permanently contoured surface that is suitable only for one particular user. As a result, such chairs do not offer the adjustability desirable to allow a wide variety of users to sit comfortably in the chair.

SUMMARY OF THE INVENTION

Accordingly, it is an object of this invention to provide a chair having an adjustable back support which adjusts quickly and easily to provide customized back support to a variety of users.

An additional object of this invention is to provide a chair having an adjustable back support of a simple, rugged, and inexpensive design, without complicated controls or construction.

A chair in accordance with one aspect of the present invention has a seat with an upwardly extending adjustable back support. The back support has a central support bar having a number of stacked segments received thereon to form a supporting surface. Each of the segments is independently slidable with respect to the support bar. In this manner, the segments can be slidably adjusted to conform the supporting surface to the back profile of a person seated in the chair. The chair has a locking mechanism for locking the segments to maintain the segments in a desired configuration.

In another aspect of the invention, each of the slidable segments is provided with a spring member which biases the segment toward its forward most position. This allows a user to easily adjust the chair by reclining naturally against the segments. As the user reclines each of the segments is pushed rearwardly by the user while the spring member biases each segment firmly against the user's back. In this manner, the segments are quickly and easily positioned in conformity with the users back profile. Once in position, the locking mechanism is actuated to maintain the segments in the desired configuration.

Other objects and aspects of the invention will become apparent to those skilled in the art from the detailed description of the invention which is presented by way of example and not as a limitation of the present invention.

DETAILED DESCRIPTION OF THE ILLUSTRATED EMBODIMENT

Figure 1:
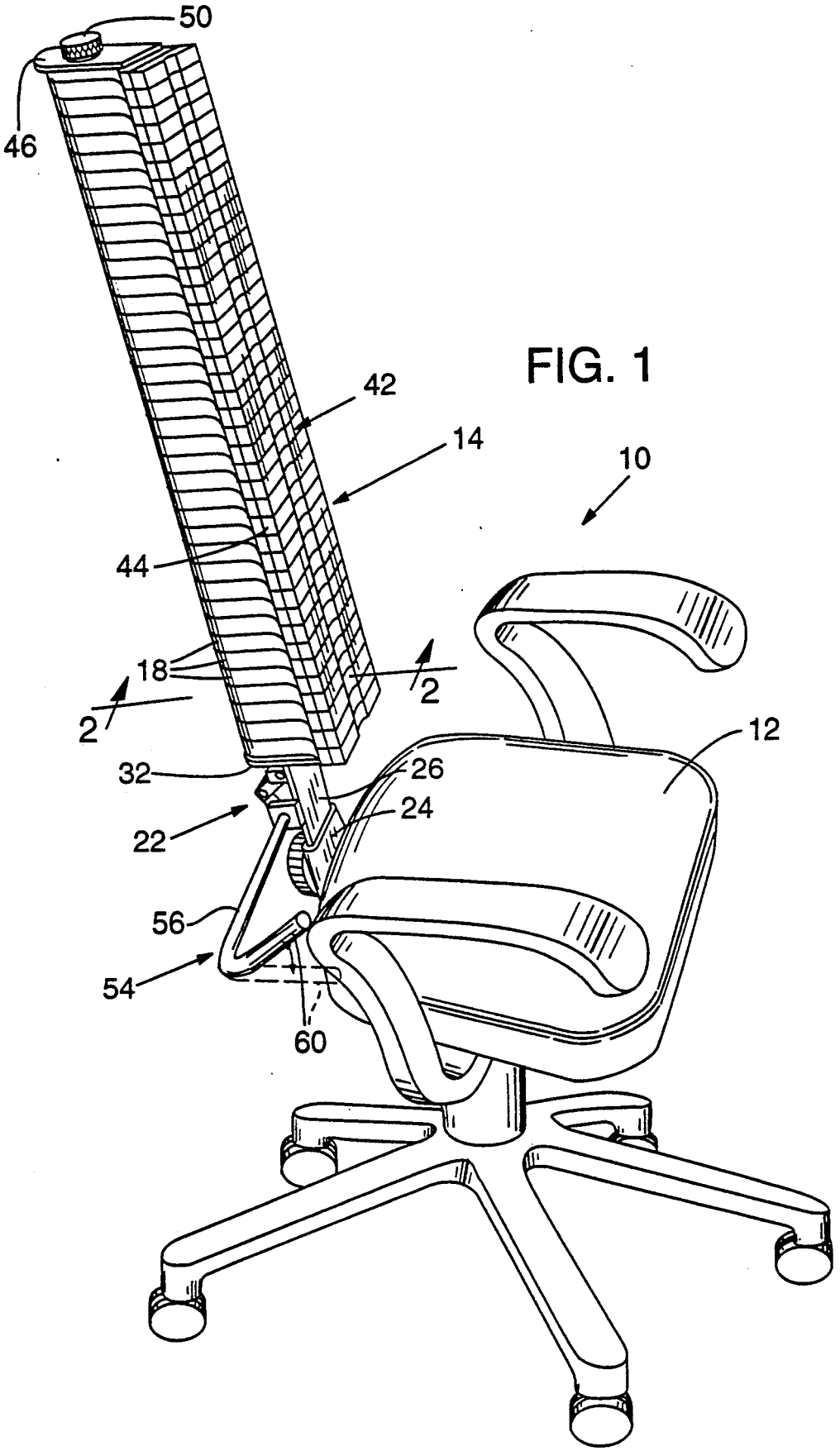
FIG. 1 is a perspective view of a chair in accordance with a preferred embodiment of the present invention.

A chair 10 in accordance with a preferred embodiment of the present invention is illustrated in FIG. 1. The chair 10 has a seat 12 and an adjustable back 14. The adjustable back 14 includes a support bar 16 (seen best in FIG. 2) extending upwardly from the rear of the seat 12. A plurality of segments 18 are stacked on the support bar 16. Each of the segments 18 has a slot 20 for slidably receiving the support bar 16. In this manner, each of the segments 18 is independently slidable in the forward or rearward direction to conform to the back of a person seated in the chair. The chair 10 has a locking mechanism 22 which can be actuated to lock the stacked segments 18 in any desired position.

The adjustable back 14 extends generally vertically upward from the rear of the seat 12, and may be attached to the seat 12 in a variety of ways. In the illustrated embodiment, the seat 12 is provided with a stem receptor 24. A stem plate 26 fixed to the lower end of the support bar 16 is received in the stem receptor 24. In the illustrated embodiment, the stem plate 26 is configured to conform with industry standards. This allows the adjustable back 14 to be fitted to an existing chair.

The stem plate 26 slides into the stem plate receptor 24 and is held in place with hand screw 28. Preferably, the stem plate 26 is provided with a slot to allow vertical adjustment of the adjustable back 14. In some embodiments, it may also be desirable to provide a mechanism to allow adjustment of the angle of the upwardly extending adjustable back 14.

Figure 2:
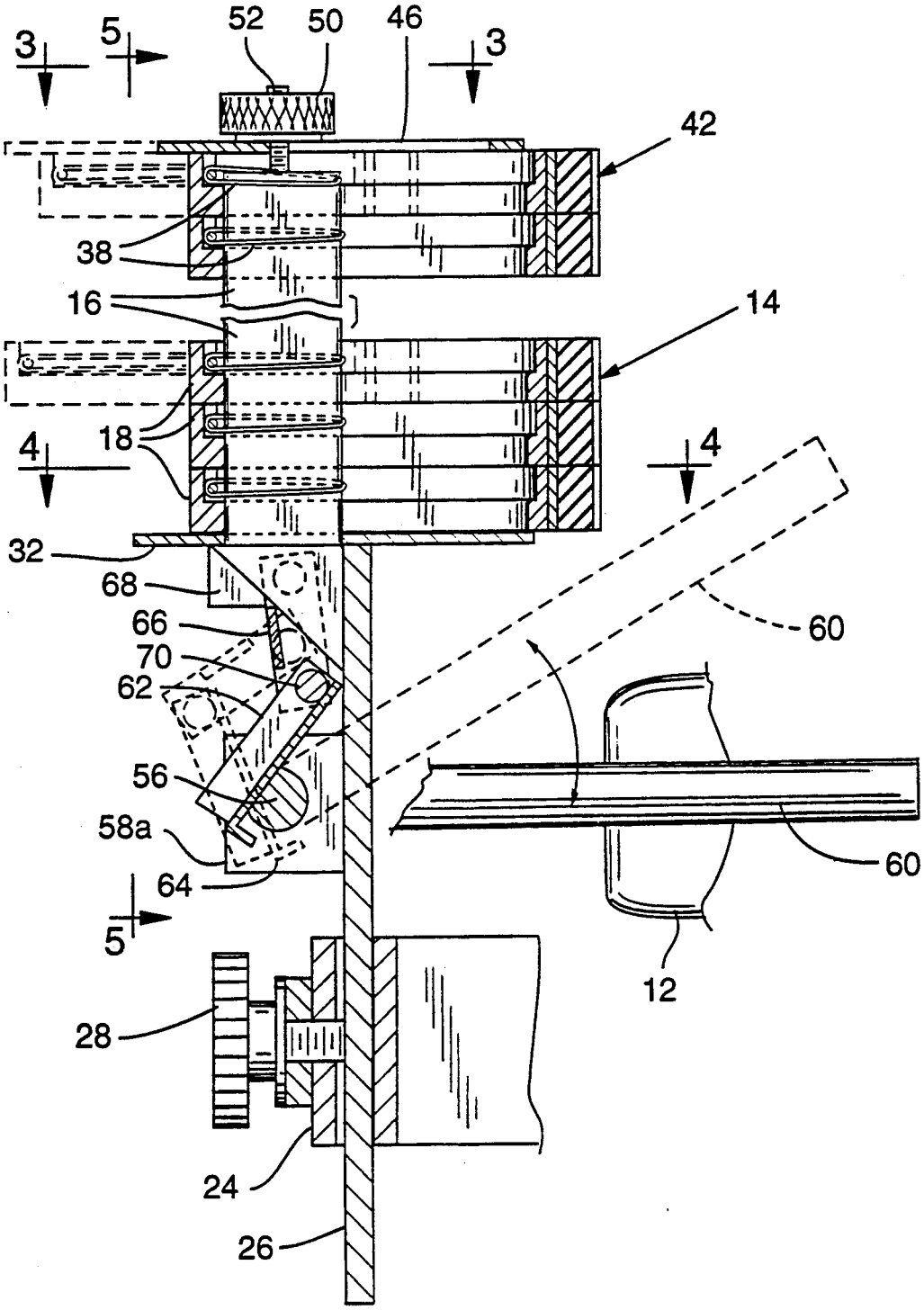
FIG. 2 is a partial cut-away side view of the adjustable chair back taken along line 2—2 of FIG. 1.

As best illustrated in FIG. 2, a lower pressure plate 32 is received on the support bar 16 above the stem plate 26. It is provided with a slot (not shown) for receiving the support bar 16. The lower pressure plate is rigid and generally planar in a manner that allows the lower pressure plate 32 to move up and down slightly on the support bar 16.

Figure 3:
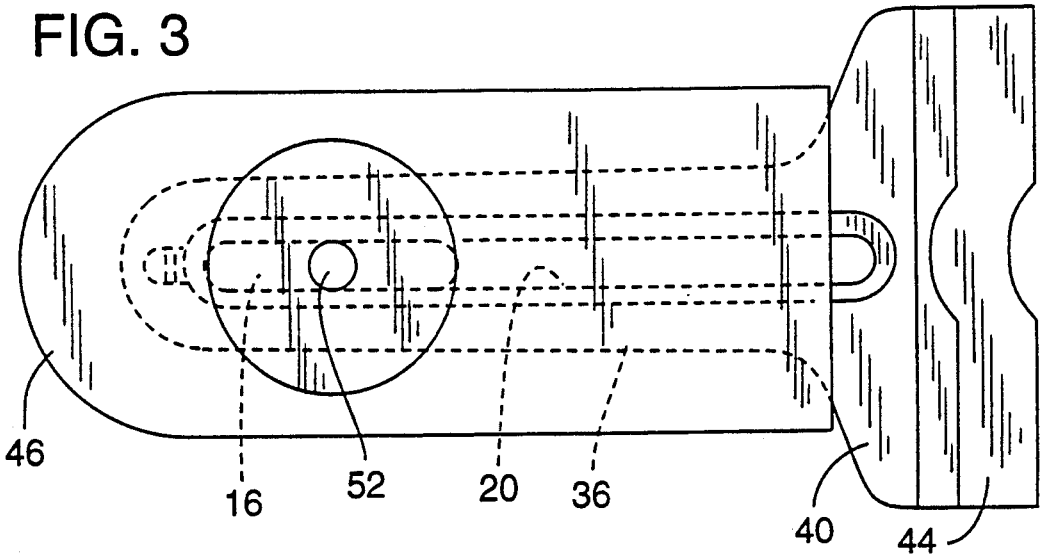
FIG. 3 is a top plan view of the adjustable chair back of FIG. 2.
Figure 4:
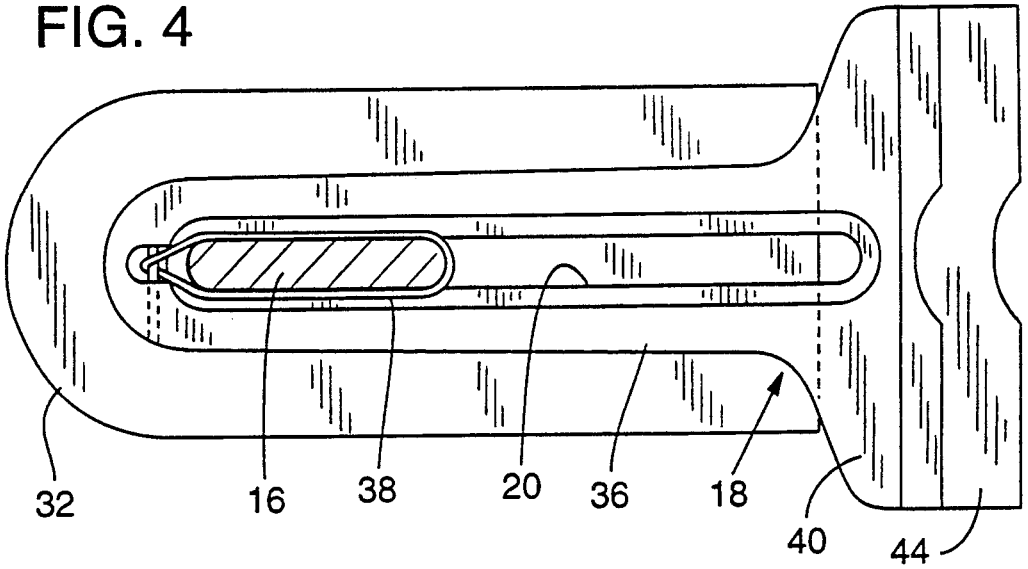
FIG. 4 is a cross-sectional view taken along line 4—4 of FIG. 2.
Figure 5:
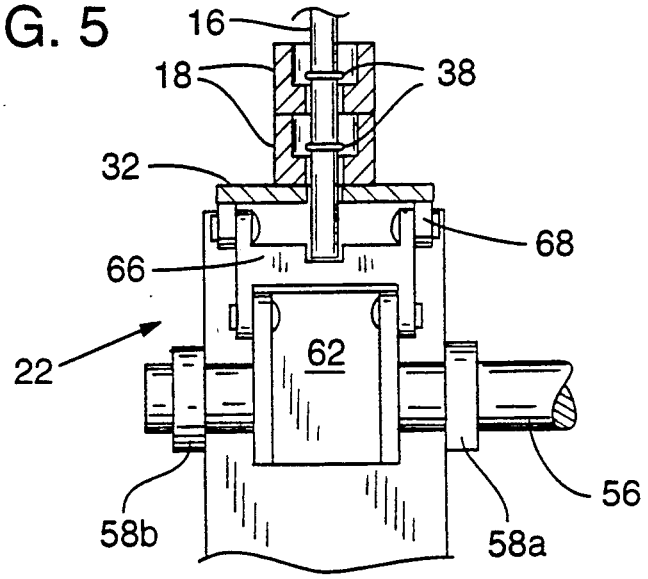
FIG. 5 is a cross-sectional view taken along line 5—5 of FIG. 2.

A number of segments 18 are stacked vertically on the lower pressure plate 32. As seen in FIGS. 3 and 4, each of the illustrated segments 18 has a generally "T" shape. The stem 36 of the "T" is provided with a slot 20 for receiving the support bar 16. The slot 20 is longer than the depth of the support bar 16 so that each segment 18 is slidable in the forward and rearward directions. In the illustrated embodiment, a rubber band 38 extends from the rear of the slot 20 around the support bar 16. The rubber band 38 serves to bias each segment 18 toward its forward most position on the support bar 16. In other embodiments, it may be desirable to use springs, or some other means of biasing the segments. For example, in an alternative embodiment, a compression spring can be positioned within the slot of each segment with one end of the spring engaging the front end of the support bar and the other end engaging the front end of the slot in the segment.

Each segment 18 is stacked on the support bar 16 with the top 40 of the "T" facing forward. In this manner, the tops 40 of the stacked segments 18 define a support surface 42 for receiving and supporting the back of a person seated in the chair 10. Because each of the individual segments 18 is independently slidable, the shape of the support surface 42 is adjustable to conform to the back of the person seated in the chair. To increase comfort, it is preferable that top 40 of each segment 18 be covered with a layer of cushion material 44. In the illustrated embodiment, the cushion is a one-half inch thick layer of neoprene. However, a variety of other types of cushions may also be used. The top 40 of each segment 18 can also be provided with a hollow or channel to receive a user's spine.

The number of segments 18 will depend on the size of the segments, the height of the user, and the desired height of the adjustable back support 14. In the illustrated embodiment, the back support extends up above the user's back to fully support the user's head and neck. However, in alternative embodiments a shorter support may be desirable. The segments 18 in the illustrated embodiment are approximately three-quarters of an inch thick. This size has been found to provide the ability to conform adequately with a user's back without unduly multiplying the number of segments needed. However, in different applications, either thicker or thinner segments may prove advantageous.

In the illustrated embodiment, the top 40 of each segments 18, and hence the width of the support surface 42, is about three inches across. This relatively narrow dimension allows the support surface 42 to directly support the user's spine. The narrow width of the support surface 42 also serves to allow closer conformity between the support surface 42 and the user's spine and allows the user's shoulders to hang naturally, tending to expand the chest and increase breathing freedom. Thus, in many instances, such a narrow support surface may be advantageous. However, it should be appreciated that the width of the support surface can vary depending on the desires of the user and the intended use of the chair. For example, in some cases, it may be desirable for the support surface to extend completely across the user's back as in a traditional chair.

As seen in FIGS. 1 and 4, the top of the support bar 16 is provided with an upper pressure plate 46. The upper pressure plate 46 has a slot 48 for receiving the support bar 16 and allowing the upper pressure plate 46 to slide in the forward or rearward directions on the support bar 16. The upper pressure plate 46 is secured in place by a knurled knob 50 threaded onto a threaded stud 52 which extends upwardly from the top of the support bar 16. The upper pressure plate 46 serves as a stop to limit the upward movement of the segments 18 on the support bar 16.

The chair 10 is provided with a locking mechanism 22, shown best in FIG. 2, for locking the segments 18 in place once they are positioned to conform to the user's back. The locking mechanism 22 of the illustrated embodiment presses the lower pressure plate 32 upward to squeeze the stacked segments 18 against one another. The friction between the stacked segments 18 prevents movement of the segments 18 locking them securely in place.

In the illustrated embodiment, the locking mechanism is actuated by a lever arm 54. The lever arm 54 has an axle portion 56 which is rotatably held by two axle blocks **58*a* and 58*b*. A handle 60 extends from the axle portion 56 at an angle. The handle 60 is configured and located such that it can be easily grasped and actuated by an individual seated in the chair 10**.

A lower elbow joint member 62 is fixed to the axle portion 56 of the lever arm 54. The lower end of the lower elbow joint member 62 serves as a stop 64 to limit movement of the lever arm 54 in the unlocked position. The upper end of the lower elbow joint member 62 is pivotably attached to an upper elbow joint member 66. The upper end of the upper elbow joint member 66 is pivotably connected to a pivot block 68 which is fixed to the underside of lower pressure plate 32. In this manner, when the lever arm 54 is moved from the unlocked position, shown in phantom in FIG. 2, to the locked position, shown in solid lines in FIG. 2, the elbow joint 70 straightens to press the pivot block 68 and lower pressure plate 32 upward. This upward movement of the lower pressure plate 32 squeezes the stacked segments 18 against the upper pressure plate 46 to prevent movement of the segments 18. In the illustrated embodiment, the locking mechanism is allowed to move slightly past the top dead center position. This helps to maintain the locking mechanism in the locked position until it is manually activated to the unlocked position by the user.

It should be understood that alternative locking mechanisms may work equally as well as the illustrated locking mechanism. For example, a cam or roller system could be used in place of the elbow joint. Other locking mechanisms, and variations thereon, which maintain the segments in a fixed position are also equivalent to the illustrated locking mechanism.

The illustrated locking mechanism 22 can be adjusted by threading the knurled knob 50 up or down on the stud 52 to raise or lower the upper pressure plate 46. The knurled knob 50 should be set such that when the locking mechanism 22 is in the unlocked position the stacked segments 18 can slide freely. However, when the locking mechanism 22 is in the locked position the segments 18 are held securely and prevent them from sliding.

As can be appreciated, to achieve optimum results from the illustrated chair back, the contacting surfaces of the segments must be smooth enough to allow the segments to move freely with respect to one another when the locking mechanism is not activated. At the same time, the contacting surfaces must provide enough friction to prevent relative movement of the segments when the locking mechanism is activated.

Figure 6:
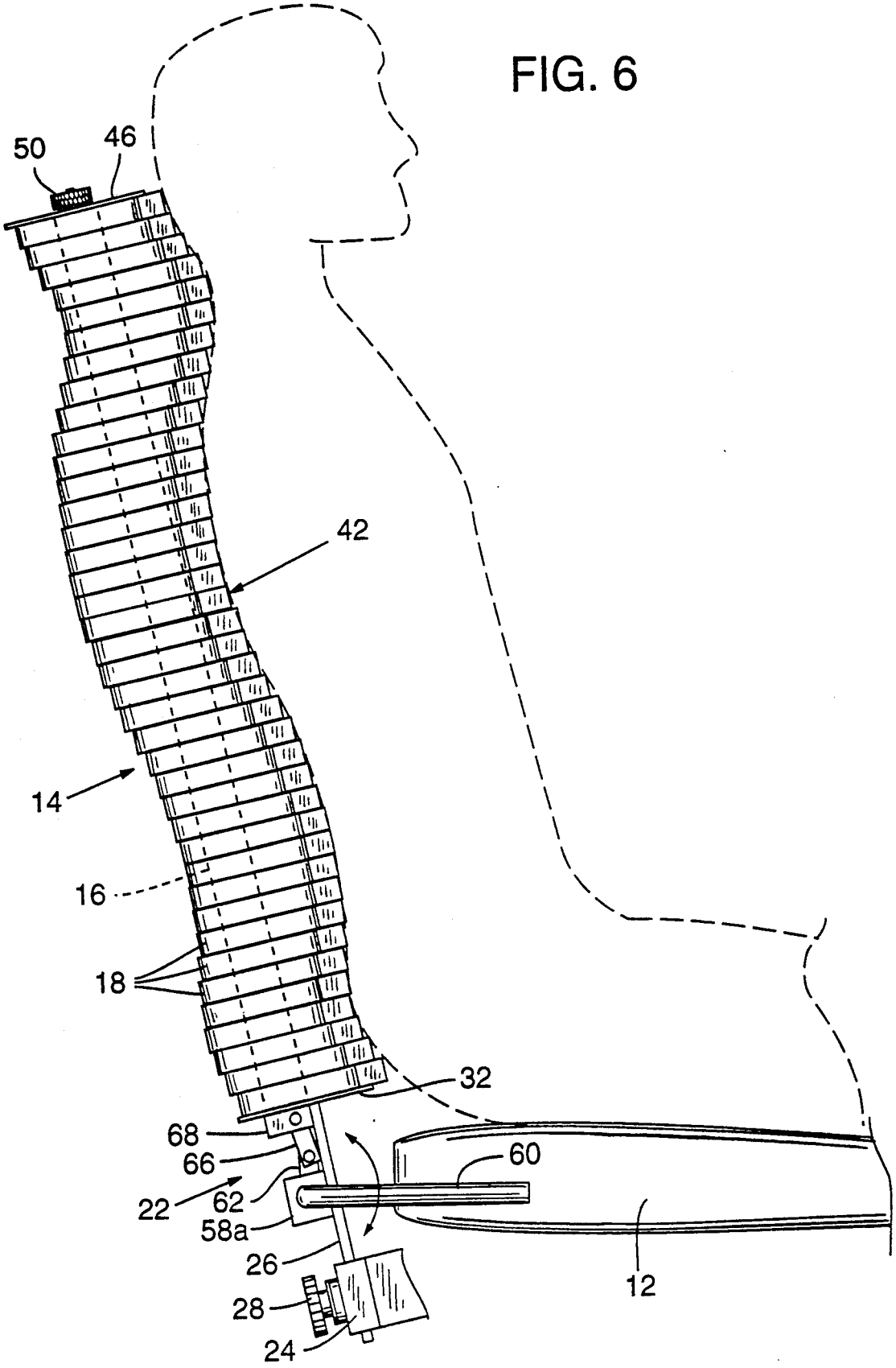
FIG. 6 is a side view of the chair of FIG. 1.

To use the chair 10, a user need only sit in the chair 10 and move the handle 60 to the unlocked position. This releases the segments 18 allowing the rubber bands 38 to urge each segment 18 toward its forward most position. With the handle 60 still in the unlocked position, the user can recline against the support surface 42, as illustrated in FIG. 6 The weight of the user's body will press the segments rearward. At the same time, the rubber bands 38 bias the segments into intimate contact against the user's back causing the support surface 42 to conform to the shape and structure of the user's back. While still reclining against the back support, the user can move the handle 60 to the locked position to actuate the locking mechanism 22 and lock the segments 18 in the desired position.

Once locked in position, the user can lean forward or stand up and the support surface 42 will retain the shape of the user's back. In this manner, the illustrated chair 10 provides an adjustable back support 14 customized to the particular user. This customized back support fully supports the user's back to increase the comfort of the user and to help reduce fatigue and back injury. In addition, by locking the back support in a desired position, the customized back support can be used to improve or maintain proper seating posture.

Because the adjustable back support 14 of the illustrated chair 10 is so quick and convenient to use, the chair is ideally suited for use by more than one individual. Each new user needs to spend only a few seconds to release the locking mechanism, lean back, and reset the locking mechanism in order to fully adjust the back support.

This detailed description is set forth only for purposes of illustrating examples of the present invention and should not be considered to limit the scope of the invention in any way. Clearly numerous additions, substitutions, and modifications can be made to these examples without departing from the scope of the invention which is defined by the appended claims and their equivalents.

I claim:

1. A chair having an adjustable back support, comprising:

a seat;

a support bar extending upwardly from said seat;

a plurality of segments received on said support bar wherein each segment defines a slot for receiving the support bar, said slot being elongated to allow the segment to slide in a forward direction; and a locking mechanism actuable from a first position in which said segments are movable in a forward direction to a second position in which said segments are held stationary.

2. A chair in accordance with claim 1 further comprising a spring mechanism associated with each segment for biasing said segment in a forward direction.

3. A chair having an adjustable back support comprising:

a seat;

a support bar extending upwardly at the rear of said seat;

a plurality of segments, each segment defining a slot and a front surface, said plurality of segments being stacked one above another with the support bar received in the slot of each segment, said slot being larger than the support bar such that each segment can move independently in the forward and rearward directions, the front surfaces of said plurality of stacked segments defining a back support surface for receiving and supporting the back of a person seated on said seat, wherein the shape of the back support surface can be altered by selectively moving the segments in the forward or rearward directions to conform to the back of the seated person; and a locking mechanism actuable to prevent movement of the segments.

4. A chair in accordance with claim 3 further comprising a spring mechanism associated with each segment to bias said segment in the forward direction.

5. An adjustable seat back, comprising:

a support bar;

a deformable back support, said back support comprised of a plurality of stacked segments, said segments each having an internal slot which receives said support bar, said slots being shaped to enable independent slidable translation of the segments;

a spring mechanism associated with the plurality of segments to urge each of the segments in the forward direction; and a locking mechanism to releasably lock the segments in a desired position.

6. An adjustable seat back according to claim 5, further comprising an attachment mechanism for attaching said adjustable seat back to a chair.

* * * * *